US005294128A

United States Patent [19]

Marquez

[11] Patent Number: 5,294,128

[45] Date of Patent: Mar. 15, 1994

[54] METHOD OF PLAYING HI-HI-LO POKER

[76] Inventor: Ruben L. Marquez, 5134 Pattijo Dr., Carmichael, Calif. 95608

[21] Appl. No.: 44,248

[22] Filed: Apr. 7, 1993

[51] Int. Cl.[5] ..... A63F 1/00

[52] U.S. Cl. ..... 273/292

[58] Field of Search ..... 273/292, 274, 309, 85 CP

[56] References Cited

U.S. PATENT DOCUMENTS 5,098,107 3/1992 Boylan et al. ..... 273/292

OTHER PUBLICATIONS

Hoyle's Simplified Guide to the Popular Card Games by Walter B. Gibson, Doubleday & Co., pp. 155–156, 1971.

Win magazine, Pai Gow Poker, pp. 39–40, 70, Apr. 1992.

Gibson, W.; "Hoyle's Simplified Guide to the Popular Card Game: High-Low, Scarne, J.; Scarne's Guide to Modern Poker", 1984; Simon & Shuster, Inc., Simon & Schuster, pp. 46–47, 1984.

*Primary Examiner*—Benjamin H. Layno

*Attorney, Agent, or Firm*—John P. O'Banion; John Costello

[57] ABSTRACT

A multiple hand variation of the card game of Hi-Lo poker involving individual players being dealt six cards, the six cards being divided into a one-card high ranking hand, a two-card high ranking hand, and a three-card low ranking hand is disclosed. The cards in the three hands are ranked according to a hierarchy which ranks individual cards according to values placed upon each card and in addition, ranks combinations of cards according to an established criteria. The players must arrange the cards in the three hands so as to maximize their overall chances of having one or more winning hands when compared to a bank player's three hands. Each player's one-card, two-card and three-card hands are compared against the bank player's respective one-card, two-card and three-card hands to determine if the player wins the hand in which case the bank player pays the player, or if the player loses the hand, in which case the player forfeits its wager for the hand, or there is a tie.

20 Claims, 3 Drawing Sheets

METHOD OF PLAYING HI-HI-LO POKER

BACKGROUND OF THE INVENTION

1. Field of the Invention

This invention pertains to a method of playing a card game, generally, and more particularly, pertains to a method of playing a modified version of Hi-Lo poker, wherein multiple players simultaneously play three hands of poker, each hand having a differing number of cards than the other hands, with the object being to arrange the cards so as to generate two hands having a high ranking and being designated as "high" hands and a third hand having a low ranking and being designated a "low" hand.

2. Description of the Background Art

The game of poker is well established in gaming circles and has been a staple of the gambling world for a number of years. The objective of poker is to garner the highest ranking hand possible in the case of "Hi" poker or, in the alternative, garner the lowest ranking hand possible as is the case in "Lo" poker. The determination of what constitutes a higher ranking hand versus a lower ranking hand, is based upon a hierarchy of card hands long established in poker. The hierarchy of card hands present in poker ranges from desirable combinations of cards having the highest rank, to undesirable combinations of cards having the lowest rank. For example, in the variation of poker known as five-card-stud, the most desirable five-card hand would be the royal "flush" which would contain the highest ranking cards, the Ace, King, Queen, Jack, Ten, all having the same suit combination (e.g. all hearts). Continuing with the five-card-stud example, the least desirable hand would be a random mixture of five of the lowest ranking cards, namely a Two, Three, Four, Five, Six, Seven, all of differing suits. Hence, it can be seen that poker ranks cards according to the value of the individual card as well as by the combinations which the cards make when combined together.

In the poker variation known as Hi-Lo poker, the objective is to achieve either the highest ranking hand or the lowest ranking hand. Hence the game of Hi-Lo poker allows the possibility of two winning hands to result. This is desirable, since it doubles each individual player's chances of winning a portion of the "pot" or wagered amount. The traditional game of Hi-Lo poker was played with a single hand, wherein each player, after being dealt a set of cards had to decide which cards he was going to discard to make either a high hand or a low hand.

The present invention discloses a variation of Hi-Lo poker called Hi-Hi-Lo poker, wherein each player simultaneously plays three hands: one low ranking hand and two high ranking hands. Hi-Hi-Lo poker allows a player to bet three wagers, thereby tripling each individual player's chances of winning a portion of the "pot" or wagered amount designated by a bank player. The increased opportunity to win a portion of the "pot", as well as the heightened amount of betting action, makes Hi-Hi-Lo poker an especially exciting and desirable game to play.

The foregoing discussion reflects the state of the art of which the applicant is aware and is tendered with the view toward discharging applicant's acknowledged duty of candor in disclosing information which may be pertinent in the examination of this application. It is respectfully stipulated, however, that none of the examples of card games mentioned previously teaches or renders obvious, singly or when considered in combination, applicant's claimed invention.

SUMMARY OF THE INVENTION

The present invention discloses a variation of Hi-Lo poker called Hi-Hi-Lo poker, wherein each player simultaneously plays three hands of poker; one low ranking hand and two high ranking hands, the ranking of the hands being determined by an established hierarchy. In the preferred embodiment, six cards are dealt, the goal being to arrange the cards into a three-card low hand, a two-card high hand and a one-card high hand. A bank player is chosen to cover the wagers of one or more players and the objective of the game is for each player to arrange his six cards so as to generate three hands which maximize the overall chances of having winning hands when compared against the hands of the bank player.

An object of the invention is to provide a method of playing poker which allows for multiple card hands to be played, simultaneously.

Another object of the invention is to provide a method of playing poker where each player tries to make two high ranking hands and a single low ranking hand.

Still another object of the invention is to provide a variation of poker wherein a bank player wagers multiple card hands against the multiple card hands played by a plurality of players.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
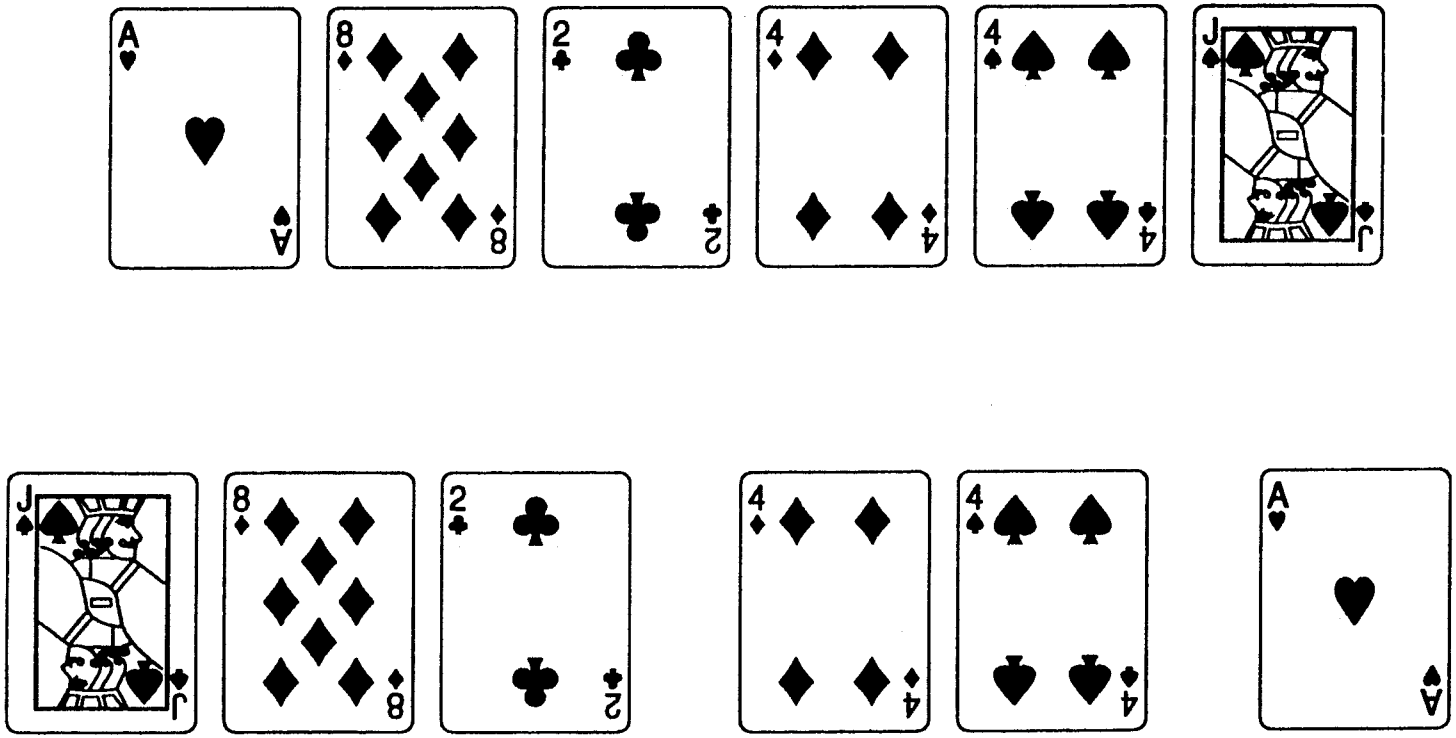
FIG. 1 is a diagrammatic plan view of a typical arrangement of a six cards into two high ranking hands and one low ranking hand in accordance with the present invention.
Figure 2:
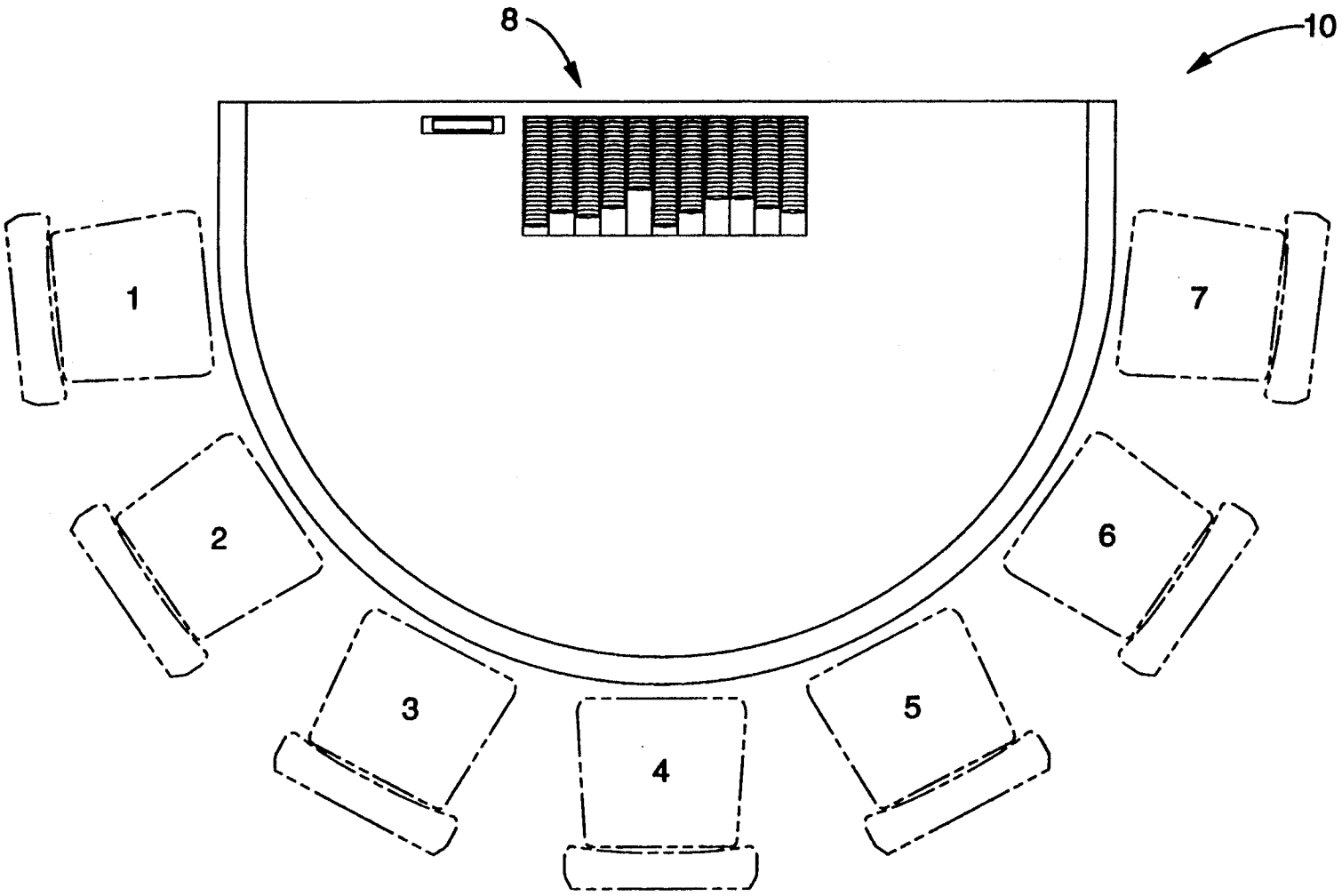
FIG. 2 is a plan view of a typical table used for playing the game of the present invention, showing the placement of seven players and a dealer.
Figure 3:
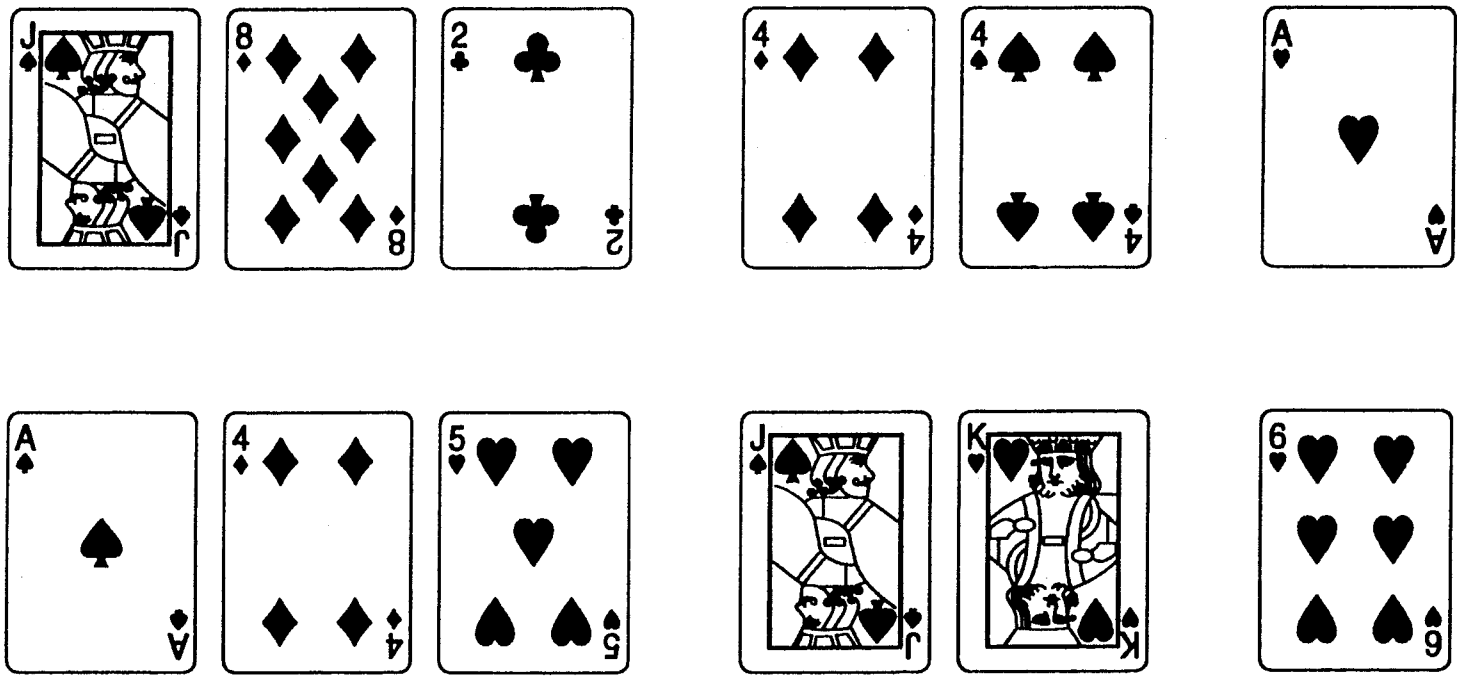
FIG. 3 is a diagrammatic plan view of typical competing sets of hands in play during a game of the present invention.

The present invention is described herein with reference to FIG. 1 through FIG. 3, which are presented for illustrative purposes. It will be appreciated that the present invention may vary as to the particular steps and their sequence without departing from the basic concepts as disclosed herein.

Referring to FIG. 1, a preferred number of six cards have been dealt for purposes of illustrating the method of arranging the six cards in accordance with the present invention. While the present invention allows the cards to be arranged into any plurality of hands, it has been found that play involving three hands is preferable in the interest of maintaining a manageable card game. These three hands are preferably divided into a one-card high ranking hand, a two-card high-ranking hand and a three-card low ranking hand. The cards used in the present invention as disclosed herein are preferably dealt from one or more fifty-two card decks, each deck having one joker. In the interest of maintaining a manageable card game, it is preferable that the players number no more than eight.

Regarding the hierarchy used for ranking the three different hands in play, any hierarchy chosen by the players, casino, or any other governing body can be applied toward the game disclosed herein. However, it is preferable that the hierarchy described below be applied. The preferred hierarchy in the present invention ranks card hands by 1) assigning numerical values to individual cards in the three hands and ranking the cards by giving the highest valued cards the highest rank and the lowest valued cards the lowest rank and 2) with regard to the two-card high ranking hand and the three-card low ranking hand, ranks combinations of cards according to an established criteria.

Accordingly, in the preferred embodiment, as Ace is assigned the highest value in the hierarchy for high ranking hands, but is also given the lowest value in the hierarchy when applied to a low ranking hand. A joker may take on any value which is most beneficial to the hand in that Jokers are used as high Aces for high ranking hands and as the lowest card missing for low ranking hands. With regards to all other cards, the individual values in descending order from highest to lowest valued are: King, Queen, Jack, Ten, Nine, Eight, Seven, Six, Five, Four, Three, and Two.

With regard to the one-card high hand, the hierarchy would rank a Two as the lowest ranking hand and an Ace as the highest ranking hand. The one-card high hand is ranked simply by determining the value of the single card and ranking it according to its value in the hierarchy of the present invention.

With regard to the two-card high hand, two types of combinations of cards are possible and therefore, rankings must be established for these two different combinations in addition to ranking according to numerical values of individual cards. The two different combinations possible for the two-card high hand are: 1) combinations comprised of two random cards and 2) combinations comprised of two numerically identical cards. With regard to combinations comprised of two random cards, (e.g. Two-Three, Nine-Ten, etc.) such a combination would not rank as high as a hand comprised of pairs of numerically identical cards (e.g. Four-Four, King-King, etc.). Hence for the two-card high hand the hierarchy would rank a pair combination of Aces as the highest ranking hand possible and a Two-Three combination as the lowest ranking hand possible. Also preferably for the two-card hand, no weight is given to combinations of cards having the same suit (commonly known as a "flush") or combinations of sequentially numbered cards (commonly known as a "straight").

With regard to the three-card low hand, three types of combinations of cards are possible and therefore, rankings must be established for these three different combinations in addition to ranking according to numerical values of individual cards. The three possible combinations are: 1) combinations comprised of three numerically identical cards (e.g. three Kings), 2) combinations comprised of two numerically identical cards plus a random third card (e.g. two Queens and a Three), 3) as well as three-card random combinations (e.g. One-Two-Three; Seven-King-Five, etc.). For these combinations the hierarchy still ranks the three cards according to the numerical ranks discussed previously, however, additionally, the following rule applies: three-card random combinations rank highest in the hierarchy; combinations comprised of two numerically identical cards plus a random third card occupy a middle rank in the hierarchy and three-card combinations comprised of three numerically identical cards rank lowest in the hierarchy. For example, a three-of-a-kind combination having numerically identical cards (e.g. three Aces), is automatically delegated to the lowest rank and therefore could not beat any combination having two numerically identical cards plus a random third card (e.g. Queen-Queen-Three). Likewise a combination having two numerically identical cards plus a random third card, could not beat any random three-card combination (e.g. One-Two-Three). Hence, with regard to the three-card low hand, the highest ranking hand possible would be a One-Two-Three combination while the lowest ranking hand possible would be three Kings. As was the case with the two-card high hand, the three-card low hand gives no weight to hands having cards of the same suit, sequential numbering, or any other criteria not imposed by the preferred hierarchy disclosed herein.

In short, the rules of the present invention provide that (1) for the one-card high ranking hand, one Ace or Joker will be the best possible hand, (2) for the two-card high ranking hand, a pair of Aces will be the best possible hand, and (3) For the three-card Low ranking hand an Ace-Two-Three combination will be the best possible hand.

It is also possible to have tying hands for the one-card high hand, two-card high hand and the three-card low hand. Tying hands are defined as two hands having the same number of cards, wherein the two hands are of equivalent rank in the hierarchy disclose herein (e.g One-Two-Three ties One-Two-Three or Seven-Eight ties Seven-Eight).

Referring again to FIG. 1, the six cards have been arranged into the preferred three hands in accordance with the hierarchy of card hands established by the present invention. The hands shown in FIG. 1 illustrate that the present invention has two objectives regarding the arrangement of the cards: (1) to arrange the six cards into a three-card low hand, a two-card high hand and a one-card high hand, and (2) to arrange the best possible combination of the three hands so as to maximize the overall chances of having winning hands when compared against a competing player's three hands.

FIG. 1 illustrates the achievement of these two objectives. In FIG. 1, the player was dealt an Ace, an Eight, two Fours, a Two and a Jack. In accordance with the first objective, the player must arrange his cards into a three-card low hand, a two-card high hand and a one-card high hand which has been done in FIG. 1. The Ace was arranged to make the one-card high hand, as the hierarchy establishes that an Ace in this position makes the highest possible ranking one-card hand. The two fours were paired to make the two-card high hand out of the remaining cards, since the pair of fours combined to make the highest ranking two-card hand according to the hierarchy. The remaining three cards, a random combination of the Jack, the Eight and the Two, combine to make the three-card low hand, with the Two being the lowest valued card of the three according to the hierarchy. In illustrating the second objective of the present invention, note that alternatively, the Ace could have replaced the Jack to make the three-card low hand, where the Ace valued as the lowest card possible in the hierarchy would have combined with the low ranking Two and the eight to create a better low hand than the one shown in FIG. 1. The Jack, then would have been used to make the one-card high hand. However, the second objective requires that arrangement of the six cards be done to maximize the overall chances of the three hands winning against competing hands having the same number of cards, and with this goal in mind, the Ace occupying the one-card high hand is a better choice than the Jack. This is because an Ace can only be tied with another Ace, while a Jack can be beaten by a King, Queen or an Ace in the hierarchy of cards. Moreover, an Ace occupying a position in the three-card low hand of FIG. 1 would result in a low hand which could be beaten by a competing hand having an identical Ace-Two combination with a third card having a lower value than the Eight. Hence, the three hands shown have the greatest chance of winning against competing hands with the Ace as the one-card high hand.

With regard to wagering on the three hands the players bet on each hand by placing a preferred three wagers total (limited to one wager per hand) prior to the cards being cut. The three wagers are preferably all for the same amount, the amount being limited by an amount declared by a bank player to cover one or more of the wagers placed by each individual player. If the bets placed by an individual player meet or exceed the amount declared by the bank player, all wagering ceases with the player who met or exceeded the declared amount risked by the bank player. For example, if the bank player declares an amount of $100.00 and the first player who starts the wagering bets $30.00 ($10.00 on each hand of the three hands), then $70.00 will remain in play. If the second player then bets $60.00 ($20.00 on each of the three hands), then $10.00 will remain in play. If the third player likewise bets $60.00 total, only $10.00 can be wagered out of the $60.00, and wagering would cease with the third player.

The role of the bank player can be played by any player at the table, or by the dealer. The amount of money or valuables to be risked by the bank player are separated from the bank player's other money or valuables. When the dealer plays the role of bank player, there is no real risk that the bank amount will be met or exceeded, since the dealer has the substantial resources of the gaming establishment in which he is employed to cover the wagers of all the players at the table.

When another player, rather than the dealer fulfills the role of the bank player, the resources of any individual player may not be vast enough to cover the wagers of every player at the table and hence, the possibility exists that all the player's bets will not be covered with every hand. To alleviate this possibility, and to insure that all the players have an opportunity to join the betting action, a method has been devised which constantly moves the betting action to different parts of the table. This method involves imposing two rules. The first rule involves changing the player designated as bank player after three sets of hands have been played. The designation of bank player then moves to the first player at the original bank player's left. This player has the option of declining the designation of bank player and passing this designation to a subsequent player at his left. The only way the original bank player can bank the game for a fourth consecutive time is if all the other players decline to be designated as bank player. However the designation of bank player creates a higher potential for gain, since the bank player is competing against all the other players at the table and if the bank player wins against all of them, substantial winnings could be garnered. The desirability of enhanced winnings naturally inspires people to exercise their option to occupy the position of bank player. If this happens, the direction of play will be constantly moved to the left, around the table, and every player will get the opportunity to competitively wager against the bank player. In addition to this first rule, a second rule can be implemented which further designates the player who has the first opportunity at the table to wager against the bank player. This rule dictates that the cards be dealt in such a fashion that the bank player receives the last cards dealt out of all the players. Upon the bank player's receiving the final card out of the six cards dealt to him, the dealer turns the next card face-up in the middle of the table. For purposes of this second rule, the cards are assigned the following values: Ace—one; two through ten—their numerical value; Jack, Queen, King—counted as eleven, twelve and thirteen, respectively. The value of the card turned face-up determines the size of the count to be undertaken in determining the player who starts the wagering.

Referring to FIG. 2, the method of implementing this additional rule is illustrated. FIG. 2 shows generally a typical gaming table 10, for playing the card game of the present invention. The table 10 has places for players 1–7 and a dealer 8. If, for example, the bank player is player 2 and the card which determines the count at which the wagering begins is a Queen, which has a value of twelve, the count begins with the first person (player 1) at the left of the bank player (player 2). The bank player (player 2) is logically excluded from the action counted, since the bank player cannot bet against himself. Being that the value for the queen is twelve, the count proceeds as follows: Player 1, 7, 6, 5, 4, 3, 1, 7, 6, 5, 4, 3. The count ends at player 3, the twelfth position from the start of the count, and likewise player 3 designates the start of the wagering action which continues with the players at his left, until the bank amount designated by the bank player is met or exceeded. Hence, no players will be excluded from the betting action, because the bank player constantly changes and the position where the wagering begins constantly changes.

At the beginning of Hi-Hi-Lo poker, the original bank player is determined by the dealer spreading a deck of cards face-down on the table and having each player at the table choose one card. The player with the highest card (Ace being the highest card) will have the option to be the bank player. If the player with the option wishes not to bank the game, the option will pass to the next player to his left, and continue this way successively, until someone accepts the designation of bank player. Should no one accept the option, the dealer can become the bank player and the game will proceed.

The bank player has the option of banking the game for one, two, or three times maximum and, upon the third time being reached, the option of bank player passes to the player to the original bank player's left. The only way a bank player can bank a game for a fourth or more consecutive times is if all other players decline to bank the game.

FIG. 3 illustrates how the bank player's hands would be compared to another player's hands in a typical round of play. In the game of Hi-Hi-Lo poker disclosed herein, the bank player's three-card hand is compared to a player's three card hand; the bank players two-card hand is compared to a player's two card hand; and the bank player's one-card hand is compared to a player's one-card hand. In FIG. 3, just such a comparison is illustrated. For comparison purposes, the upper set of three hands in FIG. 3 will be designated the bank player's and the lower set of hands will be designated a competing player's three hands. Here, with regard to the three-card low hand, the player drew a low Ace, thus allowing him to defeat the bank player's hand. Regarding the two-card high hand, the bank player's pair of fours beats the player's random Jack and King. Finally, with regards to the one-card high hand, the bank player's high Ace defeats the player's six. Hence, in the round of play depicted in FIG. 3, the bank player defeated the competing player, two hands to one.

To illustrate the previously discussed rules of Hi-Hi-Lo poker being applied to an actual round of play, FIG. 2 is again referred to for purposes of this discussion. The first step is to choose a bank player by having the dealer spread out a deck of cards face-down and allowing each player to choose one card. The player with the highest card is designated the original bank player, and in FIG. 2, player 2 will be designated to occupy this position. Once the bank player has been chosen, the players place their three equivalent bets, in anticipation of the three hands they will be dealt. At the same time the other players are placing their bets, the bank player designates a bank amount he wishes to risk against the other players. Next, the cards are cut by the player directly to the right of the bank player (player 3) and six cards are dealt to each player, starting with the player directly to the left of the bank player (player 1), and finally ending with player 2, the bank player.

The players must then arrange their cards into a one-card high hand, a two-card high hand and a three-card low hand. It is important to note that the players may not at any time receive outside assistance in arranging their hands, as the arrangement of the six cards into the three hands must be accomplished by each player alone.

After the dealer has dealt the bank player all his cards, a final card is turned face-up in the middle of the table. The value of this card determines the size of the count necessary to determine the player whom which wagering begins. If in FIG. 2, the value of the card is four, the count starts with the first player (player 1) to the left of the bank player (player 2), proceeding four places to player 5. Hence, player 5 determines the position at which comparison against the bank player's three hands begins. Play against the bank player will proceed to the left of player 5 until the cumulative wagers of the players meet or exceed the bank amount initially designated by the bank player.

For example, in FIG. 2, if the bank amount is $100.00 and proceeding to the left of player 5, player 5, 4, and 3 all wager $30.00 apiece, leaving $10.00 of the original $100.00 in play and player 1 wagers $45.00 (player 2, the bank player does not figure in this determination), the bank amount will have been exceeded by player 1 and therefore all play would cease with player 1. Winnings are then paid out accordingly and lost wagers are collected. It is also possible to have tying hands where the bank player and player have hands of equivalent rank according to the hierarchy. In the case of a tie, the player keeps his wager and the bank player does not pay out any of the bank amount to the player. Following the comparison of hands, player 2, the bank player, can then choose to pass his status as bank player to the left, to player 1, or else continue playing for a maximum of up to three sets of hands.

Accordingly, it will be seen that this invention provides a variation of the card game of Hi-Lo poker where players competitively wager multiple hands simultaneously against the multiple hands of a bank player. The variation of Hi-Lo poker disclosed herein, increases the number of hands in play to three hands, compared to traditional Hi-Lo poker which allows only one hand to be in play. Also, the method of playing Hi-Lo poker disclosed herein allows a player to play both a low hand and two high hands, simultaneously, where traditional Hi-Lo poker requires the player to choose between playing a single high hand or a single low hand. This variation of Hi-Lo poker increases the number of hands in play compared to traditional Hi-Lo poker, and likewise, increases the amount of wagering occurring at any one time. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A method of playing a card game, comprising the steps of:

(a) providing a deck of playing cards;

(b) establishing a ranking hierarchy for individual cards and combinations of cards in said deck of playing cards;

(c) dealing a plurality of cards to a player and a bank player, each said player being dealt the same number of cards;

(d) each said player dividing its cards into first and second high ranking card hands and a low ranking card hand, each said card hand having a differing number of cards;

(e) each said player arranging the cards in its card hands according to said ranking hierarchy to maximize the chances of having winning card hands when said card hands are compared against a competing player's corresponding card hands;

(f) comparing said players' low ranking card hands to determine a lowest ranking card hand, said lowest ranking card hand being declared a winning card hand;

(g) comparing said players' first high ranking card hands to determine a highest ranking card hand, said highest ranking card hand being declared a winning card hand; and (h) comparing said players' second high ranking card hands to determine a highest ranking card hand, said highest ranking card hand being declared a winning card hand.

2. A method as recited in claim 1, wherein six cards are dealt to each said player.

3. A method as recited in claim 2, wherein said low ranking card hand comprises three cards, said first high ranking card hand comprises two cards, and said second high ranking card hand comprises one card.

4. A method as recited in claim 3, wherein said step of establishing a ranking hierarchy includes the steps of assigning numerical values to said cards and ranking said cards according to said numerical values.

5. A method as recited in claim 4, wherein said step of establishing a ranking hierarchy further includes the steps of:

(a) designating a two card combination comprising numerically identical cards as a highest rank for said two card combination; and (b) designating a two card combination comprising random cards as a lowest rank for said two card combination.

6. A method as recited in claim 5, wherein said step of establishing a ranking hierarchy further includes the steps of:

(a) designating a three card combination comprising random cards as a highest rank for said three card combination;

(b) designating a three card combination comprising two numerically identical cards plus a random card as a middle rank for said three card combination; and (c) designating a three card combination comprising three numerically identical cards as a lowest rank for said three card combination.

7. A method as recited in claim 1, further comprising the steps of:

(a) selecting said bank player according to an established criteria;

(b) said bank player declaring an amount to cover said wagers of said player;

(c) said player placing a separate wager each said card hand; and (d) said player collecting said wager from said bank player for a winning card hand, said player paying said wager to said bank player for a losing card hand, the cumulative amount collected by said player or paid to said bank player not exceeding the amount declared by said bank player to cover said wagers.

8. A method as recited in claim 7, wherein selection of said bank player comprises the steps of allowing a plurality of players to each choose a single card from said deck having a numerical value, and designating the player having the card with the highest numerical value to be the bank player.

9. A method as recited in claim 8, wherein said bank player, upon being designated as such, has the option of passing said designation of said bank player to another player.

10. A method as recited in claim 9, wherein said bank player, upon exercising its option to be designated as such, has an additional option of banking said card game for up to three times maximum, said bank player being allowed to bank said card game for a fourth, or more times if all other players decline their option to be designated as bank player.

11. A method of playing a card game, comprising the steps of:

(a) providing a conventional deck of playing cards, said deck of playing cards having fifty-two cards and one Joker;

(b) establishing a ranking hierarchy for individual cards and combinations of cards in said deck of playing cards, including said Joker;

(c) dealing six cards to a player and six cards to a bank player;

(d) each said player dividing its cards into a low ranking card hand having three cards, a first high ranking card hand having two cards, and a second high ranking card hand having one card;

(e) each said player arranging the cards in its card hands according to said ranking hierarchy to maximize the chances of having winning card hands when said card hands are compared against a competing player's corresponding card hands;

(f) comparing said players, low ranking card hands to determine a lowest ranking card hand, said lowest ranking card hand being declared a winning card hand;

(g) comparing said players' first high ranking card hands to determine a highest ranking card hand, said highest ranking card hand being declared a winning card hand; and (h) comparing said players' second high ranking card hands to determine a highest ranking card hand, said highest ranking card hand being declared a winning card hand.

12. A method as recited in claim 11, further comprising the steps of:

(a) selecting said bank player according to an established criteria;

(b) said bank player declaring an amount to cover said wagers of said player;

(c) said player placing a separate wager for each said card hand; and (d) said player collecting said wager from said bank player for a winning card hand, said player paying said wager to said bank player for a losing card hand.

13. A method as recited in claim 12, wherein said step of establishing a ranking hierarchy includes the steps of assigning numerical values to said cards and ranking said cards according to said numerical values.

14. A method as recited in claim 13, wherein said step of establishing a ranking hierarchy further includes the steps of:

(a) designating a two card combination comprising numerically identical cards as a highest rank for said two card combination; and (b) designating a two card combination comprising random cards as a lowest rank for said two card combination.

15. A method as recited in claim 14, wherein said step of establishing a ranking hierarchy further includes the steps of:

(a) designating a three card combination comprising random cards as a highest rank for said three card combination;

(b) designating a three card combination comprising two numerically identical cards plus a random card as a middle rank for said three card combination; and (c) designating a three card combination comprising three numerically identical cards as a lowest rank for said three card combination.

16. The method as recited in claim 15, wherein selection of said bank player comprises the steps of allowing a plurality of players to each choose a single card from said deck having a numerical value, and designating the player having the card with the highest numerical value to be the bank player.

17. The method as recited in claim 16, wherein said bank player, upon being designated as such, has the option of passing said designation of said bank player to another player.

18. The method as recited in claim 17, wherein said bank player, upon exercising its option to be designated as such, has an additional option of banking said card game for up to three times maximum, said bank player being allowed to bank said card game for a fourth, or more times if all other players decline their option to be designated as bank player.

19. A method of playing a card game comprising the steps of:

(a) providing a conventional deck of playing cards, said deck of playing cards having fifty-two cards and one Joker;

(b) establishing a ranking hierarchy for individual cards and combinations of cards in said deck of playing cards, including said Joker, said ranking hierarchy being based upon a hierarchy of cards and card combinations commonly found in the game of poker and its variations;

(c) dealing six cards to a player and six cards to a bank player;

(d) each said player dividing its cards into a low ranking card hand having three cards, a first high ranking card hand having two cards, and a second high ranking card hand having one card;

(e) each said player arranging the cards in its card hands according to said ranking hierarchy to maximize the chances of having winning card hands when said card hands are compared against a competing player's corresponding card hands;

(f) comparing said players' low ranking card hands to determine a lowest ranking card hand, said lowest ranking card hand being declared a winning card hand;

(g) comparing said players' first high ranking card hands to determine a highest ranking card hand, said highest ranking card hand being declared a winning card hand; and (h) comparing said players' second high ranking card hands to determine a highest ranking card hand, said highest ranking card hand being declared a winning card hand.

20. A method as recited in claim 19, wherein said step of establishing a ranking hierarchy comprises the steps of:

(a) assigning numerical values to said cards and ranking said cards according to said numerical values;

(b) designating a two card combination comprising numerically identical cards as a highest rank for said two card combination;

(c) designating a two card combination comprising random cards as a lowest rank for said two card combination;

(d) designating a three card combination comprising random cards as a highest rank for said three card combination;

(e) designating a three card combination comprising two numerically identical cards plus a random card as a middle rank for said three card combination; and (f) designating a three card combination comprising three numerically identical cards as a lowest rank for said three card combination.

* * * * *